United States Patent [19]

Fukaya et al.

[11] Patent Number: 4,612,829

[45] Date of Patent: Sep. 23, 1986

[54] LEVER OPERATING DEVICE IN EXCAVATOR

[75] Inventors: Hiroshi Fukaya; Yuji Takada, both of Iruma; Masao Tamachi, Tokyo, all of Japan

[73] Assignee: Handozer Industry Co., Ltd., Japan

[21] Appl. No.: 641,869

[22] Filed: Aug. 17, 1984

[30] Foreign Application Priority Data

Jun. 12, 1984 [JP] Japan ..... 59-87059[U]

[51] Int. Cl.[4] ..... G05G 9/00; G05G 13/00

[52] U.S. Cl. ..... 74/876; 74/480 R

[58] Field of Search ..... 74/480 R, 872, 874, 74/876, 471 R

[56] References Cited

U.S. PATENT DOCUMENTS 2,387,236 10/1945 Cousino ..... 74/876 X 4,064,769 12/1977 Amdall et al. ..... 74/878

*Primary Examiner*—Allan D. Herrmann

*Attorney, Agent, or Firm*—Shlesinger, Fitzsimmons & Shlesinger

[57] ABSTRACT

A lever operating device in an excavator comprises an accelerator arm interlocked with an accelerator lever to pivot fore-and-aft, a pivotable arm interlocked with a control lever for a controlling valve of a drive unit in a working section to pivot fore-and-aft, a machine frame which bears the accelerator arm and pivotable arm arranged left and right in parallel and an abutting plate provided integrally with the accelerator arm to extend to the pivotable arm side, whereby the extending end of the abutting plate is located in the front position in the pivotal direction of turning on the controlling valve of the pivotable arm.

2 Claims, 8 Drawing Figures

LEVER OPERATING DEVICE IN EXCAVATOR

BACKGROUND OF THE INVENTION

1. Field of the Invention

This invention relates to improvements on a lever operating device in an excavator comprising a boom mounted on the machine body to be pivoted vertically by the operation of a hydraulic cylinder and a working section mounted on the end of the boom to be operated hydraulically, said lever operating device operating controllably a controlling valve of the hydraulic cylinder for pivoting the boom and a controlling valve of a drive unit for operating the working section through the operation of the lever.

2. Description of the Prior Art

Referring to a breaker providing a ground-breaking tip or tilt reciprocated vibratorily by the drive unit of the working section on the end of the boom pivotably mounted on the machine body, above configuration of the excavator is provided with a control lever for operating the controlling valve of the hydraulic cylinder for pivoting the boom and a control lever for operating the controlling valve of the drive unit for driving the tilt and further equipped with an accelerator lever for controllably operating the accelerator of an engine. And in the operation of pivoting the boom to locate the tilt of the working section on the end of the boom in a predetermined position when the excavator is operated, it is rather desirable to gently pivot the boom for accurate location so that the accelerator lever is not operated, but only the control lever connected with the controlling valve of the hydraulic cylinder for pivoting the boom is operated. However, when the actual operation is carried out by driving the tilt, a great amount of oil needs to be fed to the drive unit for the tilt so that the control lever for operating the controlling valve of the drive unit is held by one hand and the accelerator lever is held by the other hand, the operation being carried out by operating these two levers with both hands.

SUMMARY OF THE INVENTION

The present invention is proposed to simplify this operation, and an object of the present invention is to regulate freely the rotational speed of an engine without turning on a controlling valve of a tilt driving unit when an accelerator lever is pivoted while a control lever connected with said controlling valve of the tilt driving unit is interlocked with an accelerator to provide high speed rotation of the engine by pivoting the control lever for turning on a change-over valve.

And in the present invention to achieve above object, a means is proposed in which an accelerator arm connected with an accelerator lever to pivot fore-and-aft and a pivotable arm connected with a control lever for a controlling valve of a drive unit in a working section to pivot fore-and-aft are arranged left and right in parallel and supported by a machine frame, an abutting plate extending to the pivotable arm side being provided integrally with the accelerator arm so that the extending end of the abutting plate is located in the front position of the pivotable arm in the pivotal direction to turn on said controlling valve and thereby the control lever is interlocked with an operating mechanism of the accelerator.

The above-mentioned and other objects and features of the invention will become apparent from the following detailed description taken in conjunction with the drawings which indicate an embodiment of the invention.

DETAILED DESCRIPTION OF THE PREFERRED EMBODIMENT

Figure 1:
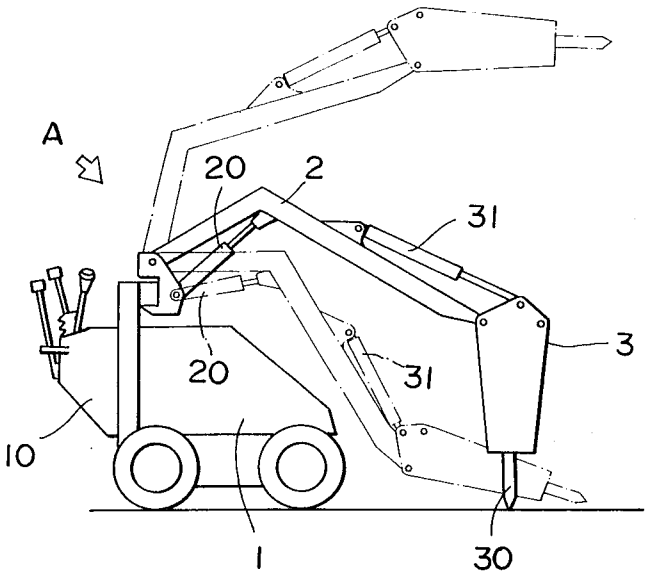
FIG. 1 is a schematic side view showing the whole excavator embodying the present invention.
Figure 2:
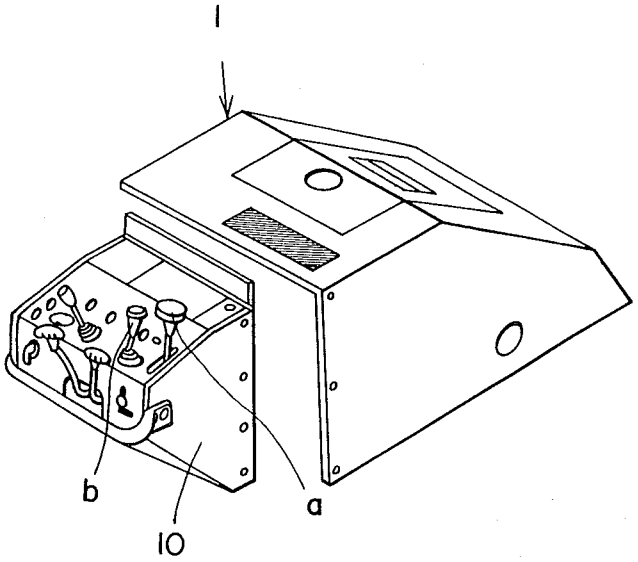
FIG. 2 is a schematic perspective view showing an essential part of said excavator.

FIG. 1 is a schematic view showing the whole breaker A embodying the present invention, in which 1 designates a machine body frame accommodating an engine, and a hydraulic unit, etc., 10 a control box mounted on the machine body frame 1, 2 a boom mounted on the machine body frame 1, 20 a hydraulic cylinder for vertically pivoting the boom 2, 3 a housing for receiving a drive unit to drive a tilt supported on an end of the boom 2, 30 a tilt attached to the housing 3, 31 a hydraulic cylinder for pivoting the housing 3, a an accelerator lever and b a control lever for operating a controlling valve of the drive unit to drive the tilt.

Figure 3:
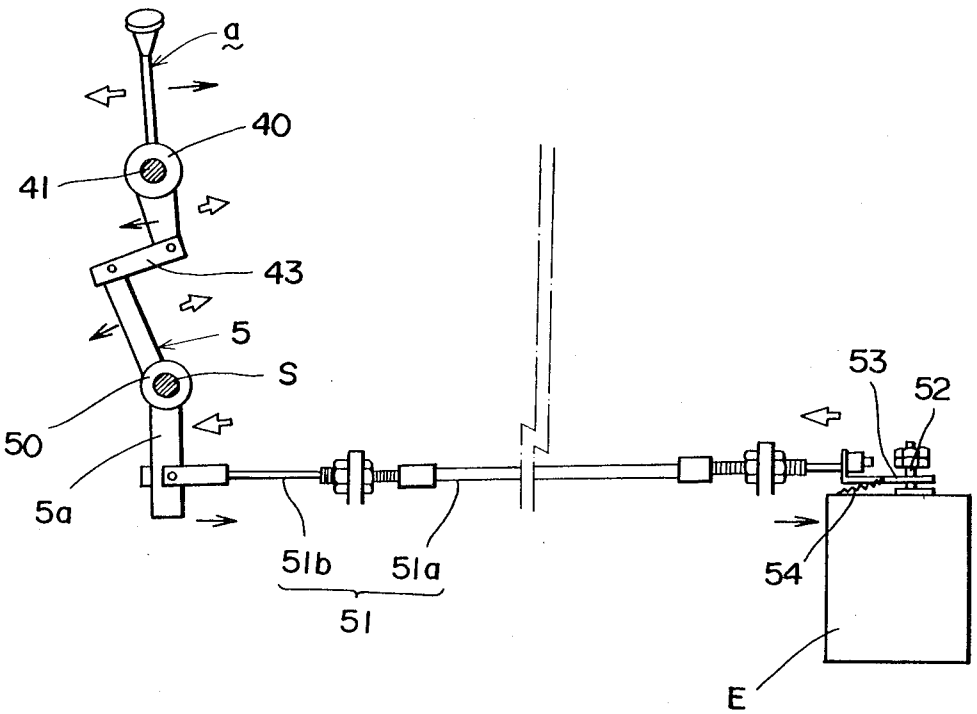
FIG. 3 is an explanatory view showing a mechanism for operating an accelerator of said excavator.
Figure 4:
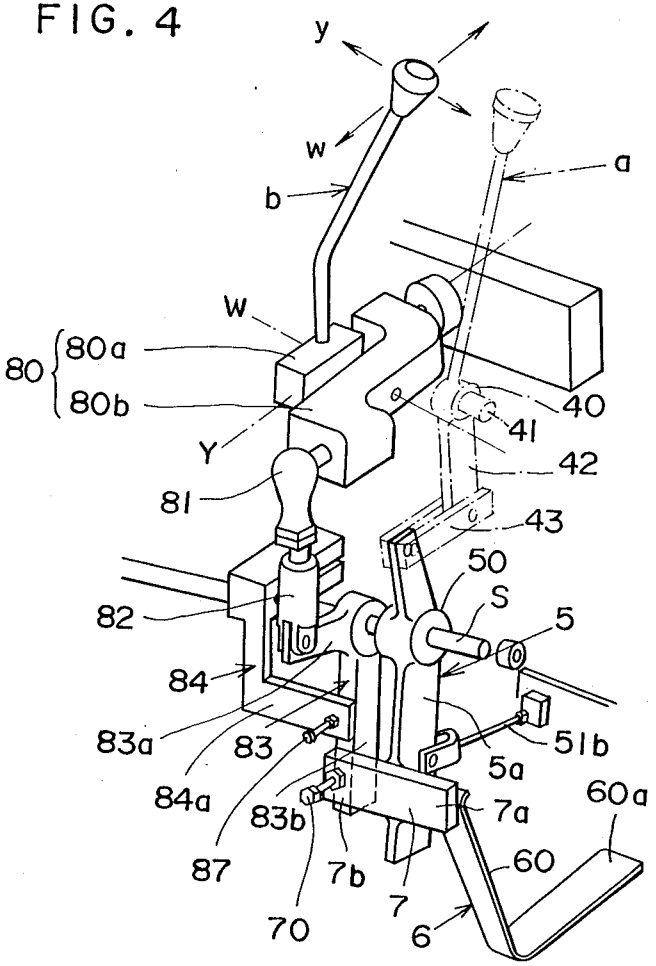
FIG. 4 is a perspective view showing an essential part of said excavator.

The base end side boss 40 of the accelerator lever a is pivotably supported by a pivot 41 mounted on a machine wall 10*a* of the control box 10 (FIG. 5) so that the accelerator lever a pivots about the pivot fore-and-aft. And the lower end of an extension 42 extending below the boss 40 is interlocked through links 43,43 with the accelerator arm 5 and the boss 50 of which fits a shaft S traversing said control box 10 and supported pivotably by same to freely pivot fore-and-aft, and the lower end side of an extension 5*a* extending below said both 50 of the accelerator arm 5, as shown in FIGS. 3 and 4, is interlocked with an operating arm 53 connected to an operating shaft 52 of the accelerator of the engine E provided in the machine body frame 1 through an interlocking machanism 51 consisting of an outer rod 51*a* and an inner rod 51*b*, the operating arm 53 being interlocked with a return spring 54. Thus, when the accelerator lever a is pulled toward this side (in the direction of arrow w in FIG. 4), the accelerator arm 5 thereby pivots in the direction of double line arrow in FIG. 3 to pull the interlocking machanism 51 and pivot the operating arm 53 of the accelerator for increasing fuel amount sucked into the cylinder of the engine E and the rotational frequency of the engine. Also, when one's hand is kept away from the accelerator lever a the operating arm 53 is pivoted to the return side by the return spring 54 so that the interlocking mechanism 51, the accelerator arm 5 and the accelerator lever a are pivoted forward (in the direction of thin line arrow in FIG. 3) to provide a condition of stopping the rotation of the engine E.

Figure 5:
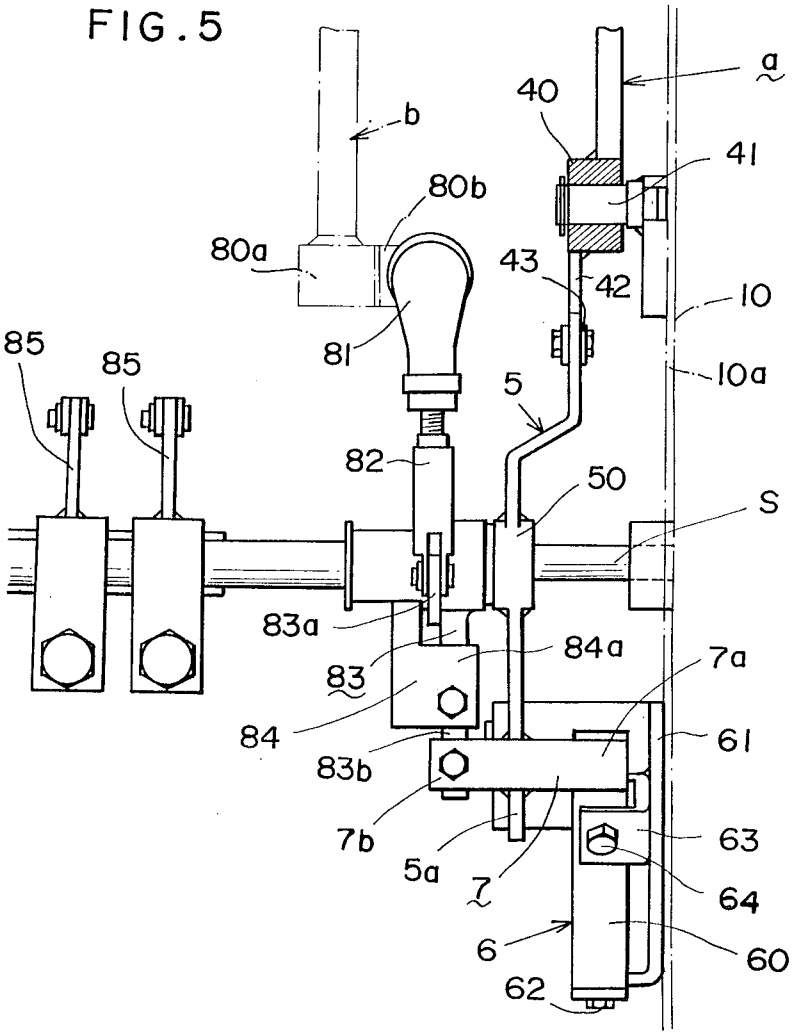
FIG. 5 is a rear view showing an essential part of said excavator.
Figure 7:
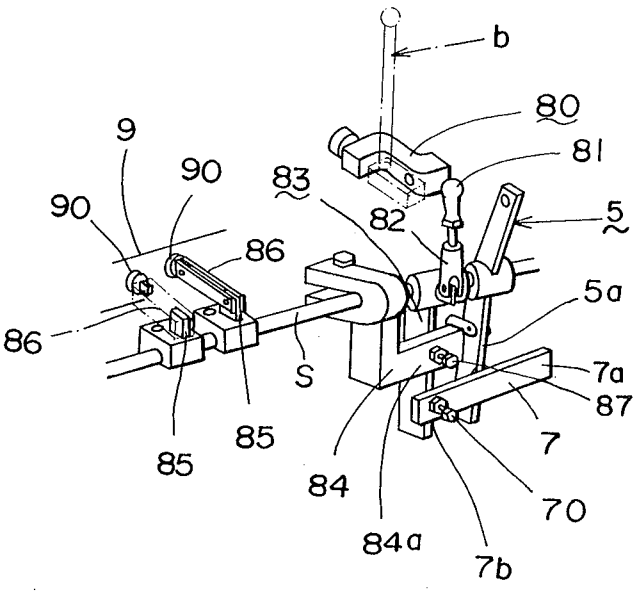
FIG. 7 is a perspective view showing the connection of a control lever and controlling valve of said excavator.
Figure 6:
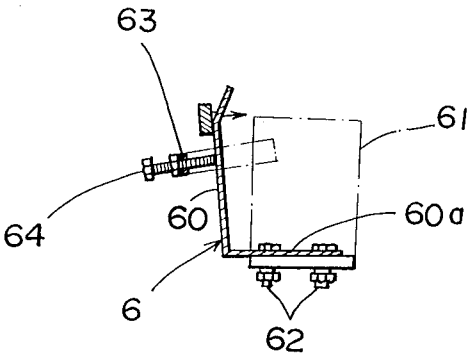
FIG. 6 is a longitudinal sectional side view showing a regulator for said excavator.
Figure 8:
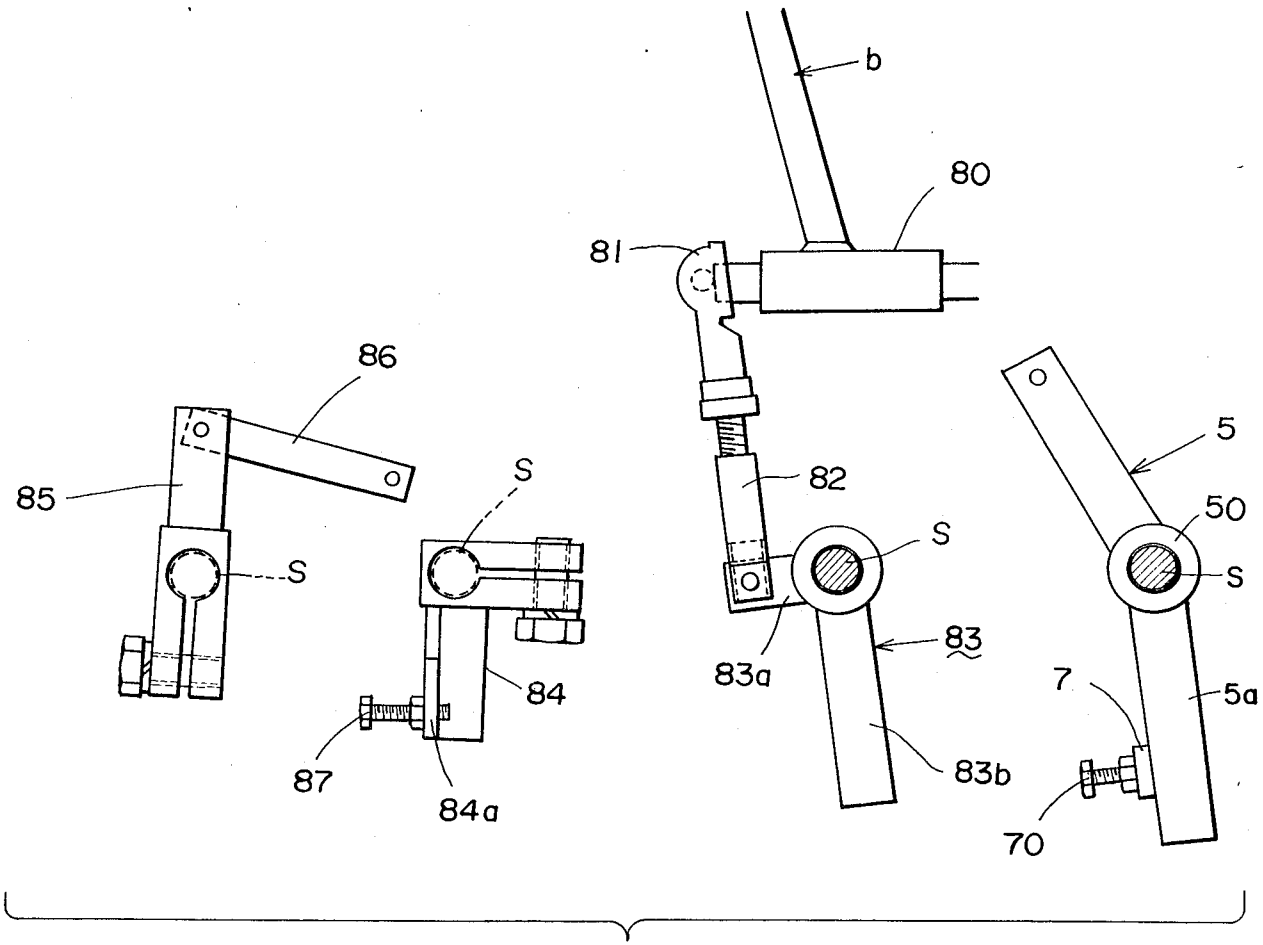
FIG. 8 is an exploded side view showing each arm provided on the shaft of said excavator.

A regulater 6 stops said accelerator lever a pivoting to the return side by the return spring 54 at a desired intermediate positon and a leaf spring 60 having spring pressure larger than that of said return spring 54 is used. As shown in FIG. 4, the leaf spring 60 is L-shaped and, as shown in FIG. 5, located at a position parallel to the extension 5*a* extending below said accelerator arm 5. The leaf spring 60 is attached to that position by fastening one bent piece 60*a* providing a mounting seat for the leaf spring to a bracket 61 mounted on the machine wall 10*a* of said control box 10 with a set bolt 62. And, as shown in FIG. 5, to the extension 5*a* extending below said accelerator arm 5 is welded integrally an abutting plate 7 long laterally and located to cross the extension 5*a* as viewed from the front. One free end 7*a* of the abutting plate 7 is located to lap the rear surface side of the upper end of said leaf spring 60 as viewed from the front and thus, when the extension 5*a* of the accelerator arm 5 is pivoted forward (to the return side) through the interlocking mechanism 51 pulled by the return spring 54, the free end 7*a* of the abutting plate 7 abuts against the rear surface of the upper end of the leaf spring 60 constituting the regulator 6 to regulate the further pivoting of said arm 5 to the return side and stop the pivoting of the accelerator lever a to the return side on the way. And an end of an adjusting screw 64 threaded into a support member 63 having the base end attached to said bracket 61 and the free end adjacent the base end side rear surface of the leaf spring 60 abuts against the leaf spring. The position of the upper end of the leaf spring 60 is displaced by the rotation of the adjusting screw 64 in the pivotal direction of the accelerator arm 5 so that the position where the abutting plate 7 is caught to stop the pivoting of the accelerator lever a is adjustably changed.

The base end of the control lever b for operating the controlling valve of the drive unit for driving the tilt is supported by a bearing block 80 having two bearing members 80*a*, 80*b* combined and joined like a universal joint to constitute a mono-lever by which two different directions of pivoting are to be carried out, that is, forward and backward pivoting (in the direction of arrow w in FIG. 4) caused by pivoting only the bearing member 80*a* about the axis W in FIG. 4 and left and right pivoting (in the direction of y in FIG. 4) caused by pivoting the bearing member 80*a* integrally with the bearing member 80*b* about the axis Y. And the controlling valve of the drive unit for driving the tilt is operated by pivoting the mono-lever left and right (in said direction of y).

That is, a link 82 is connected through a ball joint 81 to the crank-like bearing member 80*b* pivoted about the axis Y by pivoting left and right the controlling lever b, and the lower end of the link 82 is connected to one arm 83*a* of a bell crank-like pivotal arm 83 adjacent said accelerator arm 5 and supported pivotably by said shaft S. The other arm 83*b* of the pivotal arm 83 is arranged parallel to the extension 5*a* of said accelerator arm 5, and the rear surface side lower end of the arm 83*b* is adjacent the front surface side of the other free end 7*b* of said abutting plate 7 mounted on said extension 5*a* so that by bringing down the controlling lever b leftward the bearing member 80*b* is pivoted about the axis Y counter-clockwise in FIG. 4 to lift the link 82. One arm 83*a* of the pivotal arm 83 is lifted by the operation of the link 82 and the other arm 83*b* is moved rearward (toward this side) to abut against the other free end 7*b* of the abutting plate 7 and pivot the accelerator arm 5 integrally through the abutting plate 7 for increasing the rotation of the engine E. Also, when the accelerator lever a is pivoted, only the accelerator lever a is adapted to be pivoted. And an arm 84 being L-shaped as viewed from the rear is mounted rotatably integral with said shaft S in a position adjacent said pivotable arm 83 and an end 84*a* of the arm 84 bent sidewise is located adjacent the rear surface side of said pivotable arm 83. Also, working arms 85,85 rotated integrally with said shaft S are mounted on said shaft S and interlocked with controlling valves 90,90 (spool valve) provided in a valve box 9 of a controlling valve unit for controlling the drive mechanism for driving the tilt through links 86,86. Thus, as above described, when the pivotable arm 83 is pivoted toward this side by bringing down the control lever b left, the L-shaped arm 84 is pivoted to rotate the shaft S to operate the working arms 85,85 provided on the shaft S and move controlling valves 90,90 to the on-position. Further, the control lever b is returned to the original neutral positon by a force of a compression spring connected to the controlling valve 90 when the control lever b is released from one's hand.

An adjusting screw 70 threaded in the abutting plate 7 and an adjusting screw 87 threaded in the end 84*a* of the L-shaped arm 84 are used for adjusting timing as desired in the abutting of the arm 83 against the abutting plate 7 and the arm 84 when the pivotable are 83 is pivoted rearward (toward this side). In the embodiment shown, when the pivotable arm 83 is pivoted rearward, it first abuts against the abutting plate 7 to increase the rotational speed of the engine E and then abuts against the L-shaped arm 84 to operate the controlling valves 90,90.

Further, the pivoting of the control lever b in the forward and backward direction is used for operating a controlling valve (not shown) for controlling the operation of the hydraulic cylinder 20 pivoting vertically the boom 2. Also, the rightward pivoting of said control lever b becomes idle one.

Above means according to the present invention operates as follows: That is, when the control lever b is slantwise pivoted leftward from the neutral position in which it is erected as shown in FIG. 4 to move the controlling valves 90,90 to the on-position such that oil flows to the drive unit for driving the tilt 30 of the working section, the acdelerator arm 5 is moved to the side of providing high speed rotation of the engine E by the operation of the control lever b so that a great amount of oil is simultaneously supplied to the drive unit under the condition of actual operation. And since the control lever b and the engine E are connected to the accelerator operating mechanism by separable abutment of the pivotable arm 83 loosely fitted onto the shaft S for driving the controlling valve 90 against the accelarator arm 5 through the abutting plate 7 provided integrally with the accelerator arm 5, while the accelerator lever a is pivotally pulled toward this side from the neutral position (position where the abutting plate 7 provided on the accelerator arm 5 contacts the regulator 6 to provide the idling condition of the engine E) to increase the rotational frequency of the engine E, only the accelerator operating mechanism is moved, and while the accelerator lever a is pivotally pushed forward from said neutral position to stop the engine E, the control lever b and the arm 83 move together with the accelerator operating mechanism, and the shaft S and the working arms 85,85 provided thereon do not move, but only the accelerator will be operated.

As above described, according to the means of the present invention, when the accelerator lever a is operated, only the accelerator for the engine E is controlled. And when the control lever b is operated to open the hydraulic circuit for the drive unit of the working section, the rotational frequency of the engine E is increased to supply a great amount of oil to said drive unit so that the operability is remarkably facilitated.

What is claimed is:

1. A lever operating device in an excavator for controlling the movement of the excavator tilt, comprising:

an accelerator arm interlocked with an accelerator lever and pivotally mounted on the excavator to control the speed of an engine on said excavator;

a pivotable arm interlocked with a control lever and pivotally mounted on the excavator to control a valve for selectively turning on the drive unit for said tilt;

means mounting said levers on said machine for pivotable movement adjacent each other in parallel planes; and an abutting plate secured integrally with said accelerator lever to extend at one end into the pivot path of said control lever;

said mounting means including means supporting said levers in such manner that said one end of the abutting plate is located in position to be engaged by said control lever to increase the speed of said engine, when said control lever is swung in the pivotal direction of turning on said controlling valve.

2. A lever operating device as defined in claim 1, wherein said supporting means includes resilient means connected to said accelerator lever and resisting movement thereof by a said control lever in a direction to increase said engine speed.

* * * * *